US006053496A

United States Patent [19]

Nunes

[11] Patent Number: 6,053,496

[45] Date of Patent: Apr. 25, 2000

[54] FOLDING COVER WITH LIVING HINGE

[75] Inventor: Vicente P. Nunes, Mississauga, Canada

[73] Assignee: Xerox Corporation, Stamford, Conn.

[21] Appl. No.: 09/012,983

[22] Filed: Jan. 26, 1998

Related U.S. Application Data

[60] Provisional application No. 60/052,396, Jul. 14, 1997.

[51] Int. Cl.[7] ..... B65H 39/11

[52] U.S. Cl. ..... 271/292; 271/293; 271/294; 399/403

[58] Field of Search ..... 271/292–295; 399/403, 407

[56] References Cited

U.S. PATENT DOCUMENTS

| | | | |
|---|---|---|---|
| 4,895,357 | 1/1990 | Lippold | 271/8.1 |
| 5,099,292 | 3/1992 | Hirose | 271/292 |
| 5,180,158 | 1/1993 | Coombs | 271/293 |
| 5,485,253 | 1/1996 | Osbourne | 355/221 |
| 5,560,597 | 10/1996 | Bailey et al. | 271/145 |
| 5,565,965 | 10/1996 | Costanza et al. | 250/548 |

*Primary Examiner*—Chrisotpher P. Ellis
*Assistant Examiner*—Mark A. Deuble
*Attorney, Agent, or Firm*—Andrew D. Ryan

[57] ABSTRACT

A guard inhibits access between a first member and a second member having relative motion between the first member and the second member. The guard includes a body having a first portion and a second portion. The second portion is pivotably connected to the first portion by a living hinge. The first portion of the body is connected to the first member and the second portion is connected to the second member.

12 Claims, 4 Drawing Sheets

FOLDING COVER WITH LIVING HINGE

This application is based on a provisional application Ser. No. 60/052,396, filed Jul. 14, 1997.

This invention relates generally to a sorter for a printing machine, and more particularly concerns a guard for a sorter for a printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

Often when utilizing an electrophotographic printer or copier, the output or copy sheets from the printing process may require further processing. For example, the copy sheets may need to be sorted, stapled, bound or organized or subsequent operations performed immediately after the copying or printing process. Devices or attachments to perform the operations are typically attached to the copy or printing machine to accomplish these purposes. These attachments are typically called finishers. These finishers typically include areas, for example, output trays that must be accessed by the operator. Often, these trays are moved during the finishing process and therefore need to be guarded. Guards therefore need to be designed which cover operating machinery or to cover pinch points which may injure the operator.

Attempts have been made to cover moving components in finishers. The most common of these guards or covers are accordion type folding covers. Such a cover is shown in cross section in FIGS. 1B and 1C. These accordion type covers include sections that are alternately connected to each other at opposing ends. Distal ends of the cover are attached to a respective moving and stationary portion of the machine and the sections are separated and contracted as required.

An operator, however, can be harmed by having their fingers or other parts of their body caught between adjacent sections of the accordion cover. Further, the accordion type covers are expensive, fragile, and have a limited service life. Further, the accordion type covers are unsightly in appearance.

Other attempts at covering mechanical components include roller blind covers. These covers include a spring biased roller with a sheet, e.g. canvas secured to the roller. A distal end of the canvas is attached to the opposed end of the item to be covered and the material is unreeled from the roller as the components move relative to each other. The roller blind cover is expensive, not particularly durable, and does not provide adequate protection at the outer sides of the roller blind.

The cover of the present invention is intended to alleviate at least some of the above-mentioned problems.

The following disclosures may be relevant to various aspects of the present invention:

U.S. Pat. No. 5,565,965

Inventor: Costanza et al.

Issue Date: Oct. 15, 1996

U.S. Pat. No. 5,560,597

Inventor: Bailey et al.

Issue Date: Oct. 1, 1996

U.S. Pat. No. 5,485,253

Inventor: Osbourne

Issue Date: Jan. 16, 1996

U.S. Pat. No. 4,895,357

Inventor: Lippold

Issue Date: Jan. 23, 1990

The relevant portions of the foregoing disclosures may be briefly summarized as follows:

U.S. Pat. No. 5,565,965 discloses a sensor having a shutter mounted to a segment of a molded hinge for movement within a housing in opposition to a light path between an LED and a photodetector. The molded arm includes a hinge and a segment of the molded hinge extends outside the housing connected to the elongated arm. The arm includes a living hinge and an arm or elongated portion for engaging the photoreceptor and an extending member for supporting a rotating member.

U.S. Pat. No. 5,560,597 discloses a container for storing photoconductive materials. A member is used adjacent an opening to bias the material for light tightness at the opening. The member may include a component having a living hinge to provide intimate contact between the clamping member and an upper surface adjacent the opening to assure light tightness.

U.S. Pat. No. 5,485,253 discloses a corona discharge device. The device includes an electrode surrounded by a housing. The housing includes a base and a pair of panels. The panel may be attached to the base by a pair of living hinges to enable the swinging movement of the side panels relative to the base.

U.S. Pat. No. 4,895,357 discloses a locked light tight box for transporting a photosensitive sheet of photographic film. The box forms a rigid receptacle with a flat bottom and four upright sides and a lid. A plastic molding surrounding the lid forms a living hinge with the portion of the rim that is adjacent the top rearwardly facing side.

In accordance with one aspect of the present invention, there is provided a guard for inhibiting access between a first member and a second member having relative motion therebetween. The guard includes a body having a first portion and a second portion. The first portion is pivotably connected to the second portion by a living hinge. The first portion of the body is connectable to the first member and the second portion is connectable to the second member.

Pursuant to another aspect of the present invention, there is provided a sorting device for collating sheets from a printing machine into sets of sheets. The sorting device includes a housing and a plurality of trays. Each of the trays is adapted to receive a set of the sheets. The trays are operably associated with the housing and having relative motion with the housing. The sorting device also includes a mechanism connected to at least one of the trays for providing the relative motion. The sorting device further includes a guard positionable between the housing and at least one of the trays for inhibiting access to the mechanism. The guard includes a body having a first portion and a second portion. The first portion is pivotably connected to the second portion by a living hinge.

Pursuant to yet another aspect of the present invention, there is provided an electrophotographic printing machine having a sorting device for collating sheets from a printing machine into sets of sheets. The sorting device includes a housing and a plurality of trays. Each of the trays is adapted to receive a set of the sheets. The trays are operably associated with the housing and having relative motion with the housing. The sorting device also includes a mechanism connected to at least one of the trays for providing the relative motion. The sorting device further includes a guard positionable between the housing and at least one of the trays for inhibiting access to the mechanism. The guard includes a body having a first portion and a second portion. The first portion is pivotably connected to the second portion by a living hinge.

Other features of the present invention will become apparent as the following description proceeds and upon reference to the drawings, in which.

Figure 1:
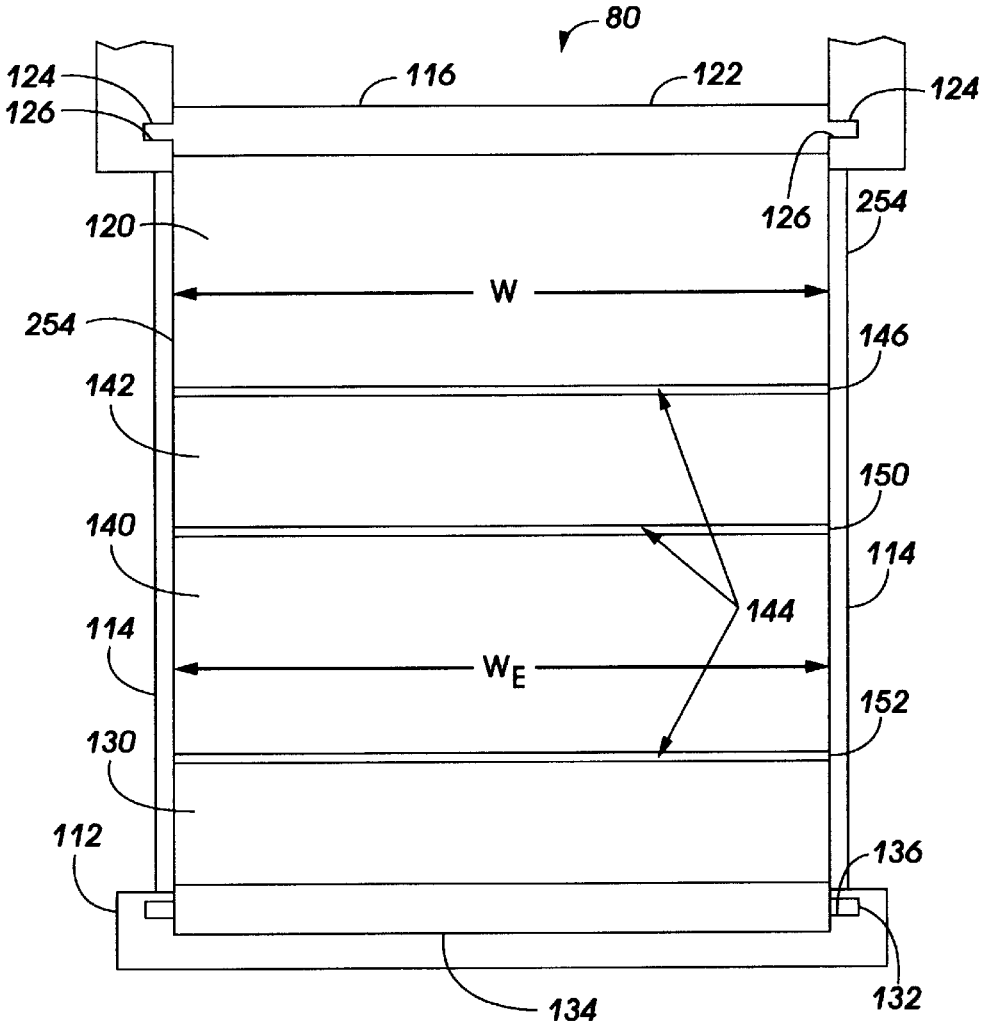
FIG. 1 is an plan view of a guard having an integral living hinge according to the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to FIG. 5, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

A document 34 to be reproduced is placed on a platen 22, located at imaging station B, where it is illuminated in a known manner by a light source such as a lamp 24 with a photo spectral output matching the photo spectral sensitivity of the photoconductor. The document thus exposed is imaged onto the drum 16 by a system of mirrors 25 and lens 27, as shown. The optical image selectively discharges surface 28 of the drum 16 in an image configuration whereby an electrostatic latent image 32 of the original document is recorded on the drum 16 at the imaging station B.

At development station C, a development system or unit, indicated generally by the reference numeral 36 advances developer materials into contact with the electrostatic latent images. The developer unit includes a device to advance developer material into contact with the latent image.

The developer unit 36, in the direction of movement of drum 16 as indicated by arrow 18, develops the charged image areas of the photoconductive surface. This developer unit contains, for example, black developer material 44 having a triboelectric charge such that the black toner is attracted to charged areas of the latent image by the electrostatic field existing between the photoconductive surface and the electrically biased developer rolls in the developer unit, which are connected to bias power supply 42, attracts the toner to the latent image.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are removed at cleaning station F. The cleaning station F includes a blade 74.

It is believed that the foregoing description is sufficient for purposes of the present application to illustrate the general operation of an electrophotographic printing machine incorporating the development apparatus of the present invention therein.

Figure 4:
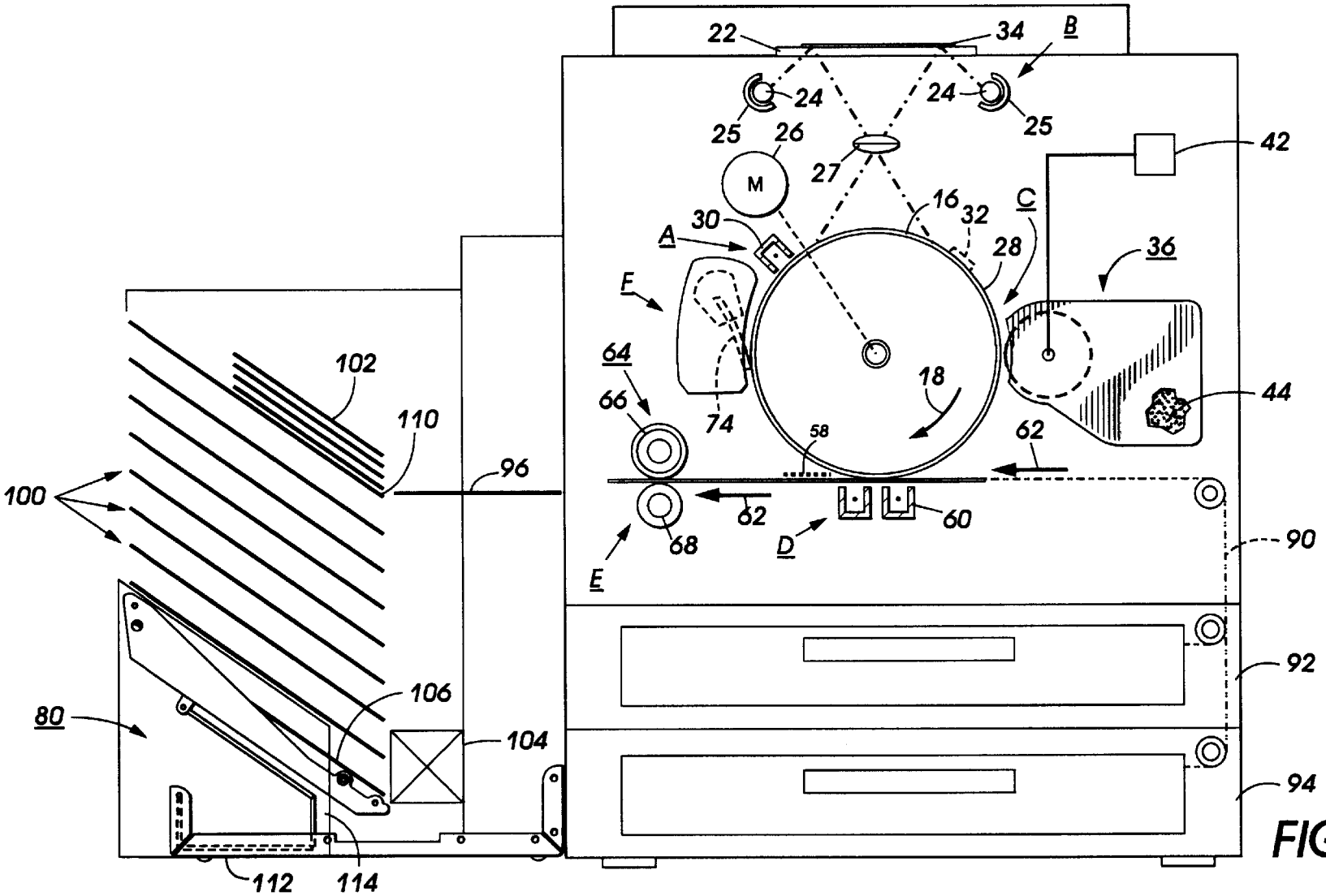
FIG. 4 is a schematic elevational view of an electrophotographic printing machine including a sorting device incorporating the FIG. 1 guard therein.

According to the present invention and referring now to FIG. 4, a folding cover 80 is shown. The folding cover 80 is mounted in the lower portion of sorter 82. The sorter 82 is positioned adjacent print engine 84 of copy machine 86. Sheets 58 are transported by paper transport 90 from either upper paper tray 92 or lower paper tray 94 through the print engine 84 to paper output feeding position 96.

Figure 2:
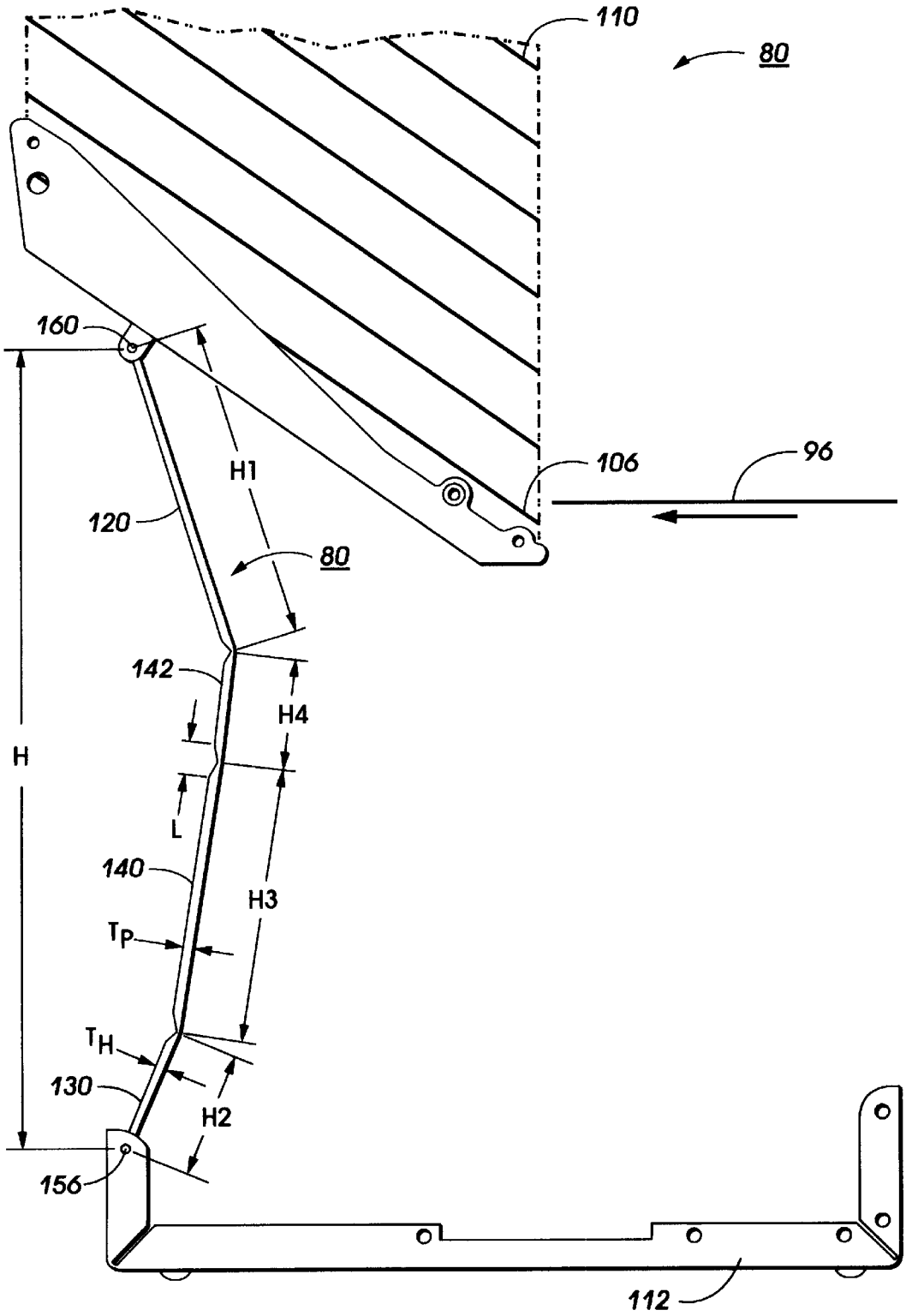
FIG. 2 is a partial end view of the guard of FIG. 1 installed into a sorting device with a sorting tray in the upmost position.
Figure 3:
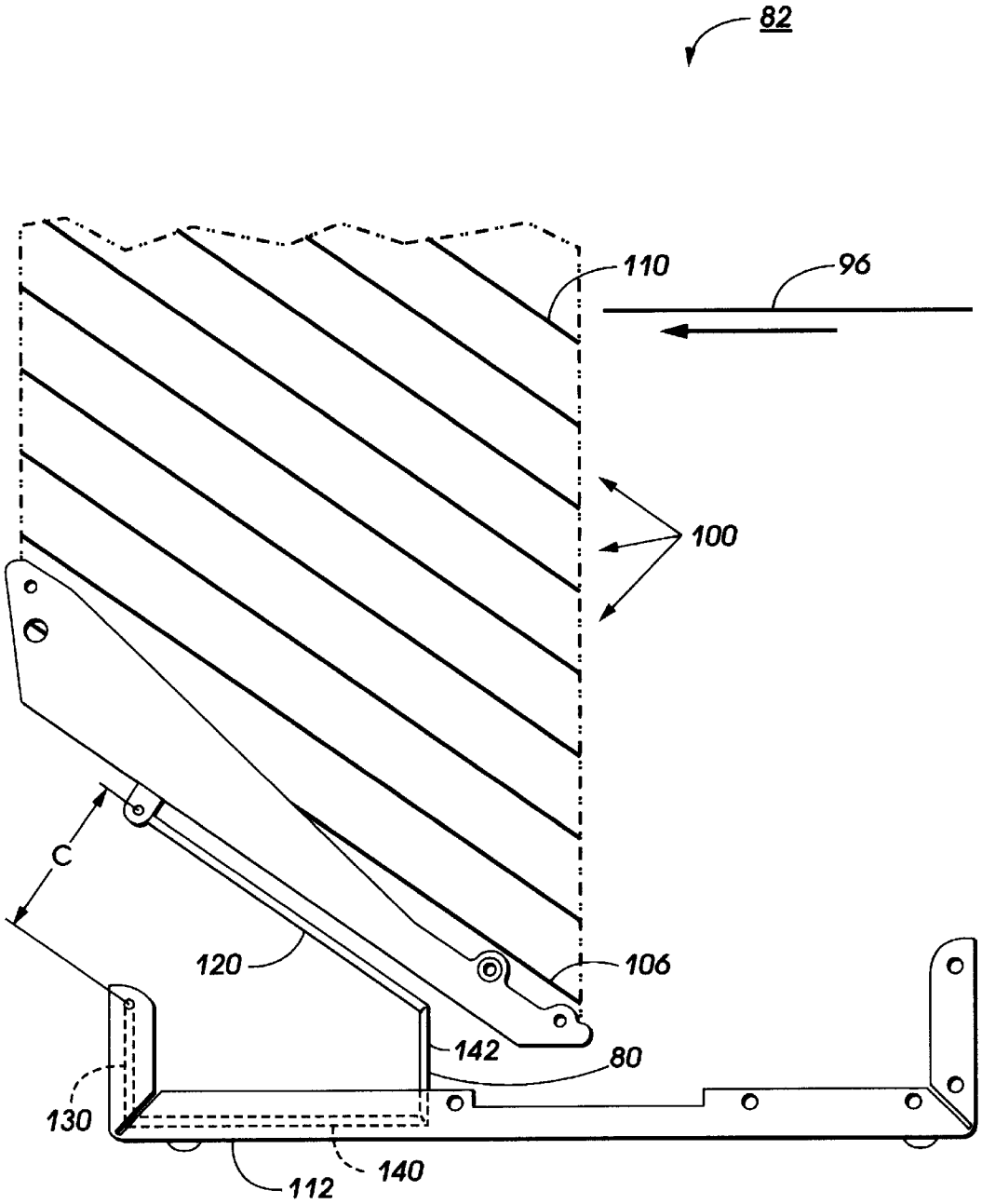
FIG. 3 is a partial end view of the guard of FIG. 1 installed into a sorting device with a sorting tray in the downmost position.

The sorter 82 includes a plurality of sheet sorting bins 100 which are positioned on an incline to assist in registering an edge of the sheet against a lower portion of the bins 100. The sheets 58 are fed from the paper feeding position 96 into the bin 100 which is in alignment with the paper feeding position 96. The sheets that enter the bin 100 form a set 102. To provide for placing sheets 58 in each of the sheet sorting bins 100, a bin mechanism 104 is attached to the bins 100 and raises and lowers the bins 100 such that each of the bins 100 at a particular position may be in alignment with the paper feeding position 96. This can be most easily understood by referring to FIGS. 2 and 3. In FIG. 2, the paper feeding position 96 is in alignment with bottom bin 106, while FIG. 3 shows the paper feeding position 96 in alignment with top bin 110.

Referring again to FIG. 4, the folding cover 80 is shown positioned between sorter frame 112 in the form of a first member, and bottom bin 106 in the form of a second member. As can be appreciated, the folding cover 80 protects an operator standing outside the sorter 82 from access to the bin mechanism 106. End covers 114 are positioned adjacent ends of the folding cover 80 to prevent access into the bin mechanism 104.

Referring now to FIG. 1, folding cover 80 is shown in greater detail. The folder cover 80 may be made of any suitable durable material but preferably is made of a plastic. Such a suitable plastic material is polypropylene.

The folding cover 80 includes a body 116. The body 116 includes a first portion 120. The first portion 120 is preferably in the form of a panel having a generally rectangular shape and a thickness $T_p$ (see FIG. 2). The first portion 120 of the body 116 is located adjacent first end 122 of the cover 80. The first end 122 of the cover 80 is preferably secured to one of the bins 100. Preferably, the first end 122 of the cover 80 is secured to bottom bin 106. The first end 122 is preferably pivotally secured to the bottom bin 106. The cover 80 can be pivotally secured in any fashion, for example, as shown in FIG. 1, the folding cover 80 is pivotally secured to the bottom bin 106 by protrusions 124 extending outwardly from first end 122 of the cover 80. The protrusions 124 are fitted into openings 126 in bottom bin 106.

The body 116 of the folding cover 80 also includes a second portion 130 of the body 116. The second portion 130, like portion 120, is preferably in the form of a panel having a rectangular shape and a thickness $T_p$. The second portion 130 of body 116 is preferably secured to sorter base 112. The second portion 130 may be pivotally secured to sorter base 112 in any suitable fashion. For example, the second portion 116, as shown in FIG. 1, includes protrusions 132 extending outwardly from second end 134 of cover 80. The protrusions 132 cooperate with apertures 136 in the sorter base 112.

While the invention may be practiced with as few as two portions or panels, preferably, the folding cover 80 includes a third portion or panel 140 positioned between first portion 120 and second portion 130 of cover 80. The third portion 140 is similar to first portion 120 and second portion 130, having a rectangular shape and a thickness $T_p$.

As shown in FIG. 1, the folding cover 80 may further include a fourth portion or panel 142 positioned between third panel 140 and first panel 120 of body 116. The fourth panel 142 is similar to first, second and third panel 120, 130 and 140 respectively.

To provide for the folding of the folding cover 80, the panels 120, 130, 140 and 142 are adjoined to each other by living hinges 144. The living hinges 144 are preferably integrally molded with the folding cover 80. For example, a first living hinge 146 is positioned between first portion 120 and fourth portion 142. Similarly, a second living hinge 150 is positioned between third portion 140 and fourth portion 142. Also, a third living hinge 152 may be positioned between second portion 130 and third portion 140 of the body 116 of the folding cover 80.

Referring again to FIG. 1, the folding cover 80 has opposed edges 254 which cooperate with end covers 114 to prevent access to the sides of the sorter 80 preventing entry to the bin mechanism 104. Preferably, the folding cover 80 has a panel width W which is slidably engageable with the end covers 114. The end covers 114 are spaced apart by a distance $W_E$ which is approximately equal to width W of the panel.

Referring now to FIG. 2, the folding hinge 80 is shown connected between sorter base 112 and bottom tray 106. As shown in FIG. 2, the folding cover 80 is in its extended or upmost position. It can be seen that in its upmost or stretched position, the folding cover 80 remains in a bent or folded position. By maintaining the folding cover 80 in a partially folded position through all motion of the folding cover 80, the direction of the folding cover during movement of the bin mechanism 104 including the direction and position of the panels 120, 130, 140 and 142 may be controlled during the motion thereof. The first portion 120 has a length H1, the second portion 130 has a length H2, the third portion 140 has a length H3, and the fourth portion 142 has a length H4. The distance between lower pivot axis 156 and upper pivot axis 160 has a length H. To maintain the folding cover 80 in a folded position, the height H must remain greater than the sum of H1, H2, H3 and H4.

The living hinges 144 may have any suitable size and shape necessary to provide the folding properties required for the application. For example, the living hinge has a thickness $T_H$ of approximately 0.02 to 0.15 inches and a length L of 0.10 to 0.80 inches.

Referring now to FIG. 3, the sorter 82 is shown with the bins 100 in the lower position such that top bin 110 is in alignment with the paper feeding position 96. In this position, the folding cover provides for a clearance C between first portion 120 and second portion 130 of the folding cover 80. Clearance C is preferably greater than 3.5 inches in order to prevent a hand or foot from being caught in the space between the first and second portions of the folder cover 80.

Figure 1A:
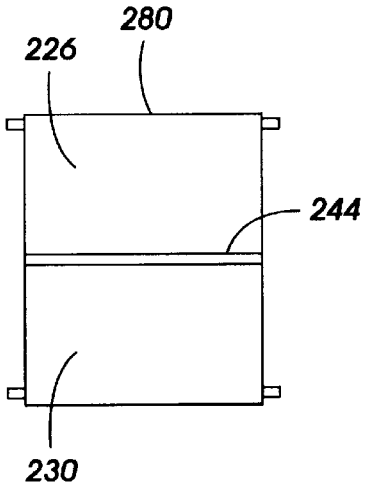
Figure 1B:
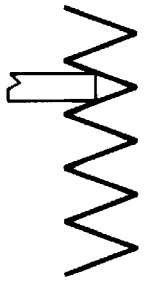
FIG. 1B PRIOR ART
Figure 1C:
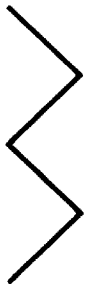
FIG. 1C PRIOR ART

Referring now to FIG. 1A, an alternate embodiment of the folding cover of the present invention is shown as folding cover 280. Folding cover 280 is similar to folding cover 80 except that the folding cover 280 includes a first portion 220 and a second portion 230. The first portion 220 and the second portion 230 are separated by a living hinge 244.

While the folding cover 280 is simpler than folding cover 80, folding cover 280 may potentially have a pinch point between the first panel 220 and the second panel 230.

By providing a guard in the form of a folding cover with living hinge, a low cost and highly reliable guard can be provided.

By providing a guard in the form of a folding cover with an integral living hinge having at least three folding panels, a folding cover an be provided which has no pinch points.

By providing a guard in the form of a folding cover having living hinges, a guard can be provided which provides for ample protection on the sides of the guard.

By providing a guard in the form of a folding cover which is not fully extended in the extended position, a folding cover can be provided which reliably refolds into the proper position.

By providing a guard in the form of a folding cover, a guard can be provided which is aesthetically pleasing and simple.

It is, therefore, apparent that there has been provided in accordance with the present invention, a guard that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A sorting device for collating sheets from a printing machine into sets of sheets, said sorting device comprising:

a housing;

a plurality of trays, each of said trays adapted to receive a set of said sheets, said trays operably associated with said housing and having relative motion therewith;

a mechanism connected to at least one of said trays for providing the relative motion thereto; and a guard positionable in one or more positions between the housing and at least one of said trays for inhibiting access to a portion of said printing machine, said guard comprising a body having a plurality of portions, at least two portions connected to each other by at least one living hinge so that each portion forms an interior angle with its adjacent portion, each interior angle being on a same side of the guard.

2. The sorting device according to claim 1, wherein said plurality of portions comprises a first portion connectable to said housing and a second portion connectable to at least one of said mechanism and one of said trays.

3. The sorting device according to claim 1, wherein:

said plurality of portions comprises a first portion pivotably connected to said housing; and a second portion pivotably connected to one of said trays.

4. The sorting device according to claim 1, wherein said body comprises polypropylene.

5. The sorting device according to claim 1, further comprising:

a first protrusion, integral with said body, for cooperation with said housing; and a second protrusion, integral with said body, for cooperation with one of said trays.

6. The sorting device according to claim 1:

wherein said plurality of portions comprises a first portion, a second portion, and a third portion, the third portion positioned between said first portion and said second portion; and further comprising a second living hinge spaced from a first living hinge, one of said first living hinge and said second living hinge being positioned between said first portion and said third portion and the other of said first living hinge and said second living hinge being positioned between said second portion and said third portion, so that said first portion and said second portion are spaced from each other during the relative motion between said housing and at least one of said trays.

7. An electrographic printing machine having a sorting device for collating sheets from the printing machine into sets of sheets, said sorting device comprising:

a housing;

a plurality of trays, each of said trays adapted to receive a set of said sheets, said trays operably associated with said housing and having relative motion therewith;

a mechanism connected to at least one of said trays for providing the relative motion thereto; and a guard positionable in one or more positions between the housing and at least one of said trays for inhibiting access to a portion of said printing machine, said guard comprising a body having a plurality of portions, at least two portions connected to each other by at least one living hinge so that each portion forms an interior angle with its adjacent portion, each interior angle being on a same side of the guard.

8. The printing machine according to claim 7, wherein said plurality of portions comprises a first portion connectable to said housing and a second portion connectable to at least one of said mechanism and one of said trays.

9. The printing machine according to claim 7, wherein:

said plurality of portions comprises a first portion pivotably connected to said housing; and a second portion pivotably connected to one of said trays.

10. The printing machine according to claim 7, wherein said body comprises polypropylene.

11. The printing machine according to claim 7, further comprising:

a first protrusion, integral with said body, for cooperation with said housing; and a second protrusion, integral with said body, for cooperation with one of said trays.

12. The printing machine according to claim 7:

wherein said plurality of portions comprises a first portion, a second portion, and a third portion, the third portion positioned between said first portion and said second portion; and further comprising a second living hinge spaced from a first living hinge, one of said first living hinge and said second living hinge being positioned between said first portion and said third portion and the other of said first living hinge and said second living hinge being positioned between said second portion and said third portion, so that said first portion and said second portion are spaced from each other during the relative motion between said housing and at least one of said trays.

* * * * *